US007153162B2

(12) United States Patent
Mizumura et al.

(10) Patent No.: US 7,153,162 B2
(45) Date of Patent: Dec. 26, 2006

(54) BOARD CONNECTING CONNECTOR AND METHOD FOR PRODUCING THE SAME

(75) Inventors: Akinori Mizumura, Kanagawa (JP); Atsuhito Noda, Tokyo (JP)

(73) Assignee: Molex Incorporated, Lisle, IL (US)

( * ) Notice: Subject to any disclaimer, the term of this patent is extended or adjusted under 35 U.S.C. 154(b) by 117 days.

(21) Appl. No.: 10/478,582

(22) PCT Filed: May 23, 2002

(86) PCT No.: PCT/US02/16388

§ 371 (c)(1),
(2), (4) Date: Jun. 18, 2004

(87) PCT Pub. No.: WO02/095878

PCT Pub. Date: Nov. 28, 2002

(65) Prior Publication Data

US 2004/0235321 A1 Nov. 25, 2004

(30) Foreign Application Priority Data

May 23, 2001 (JP) ..... 2001-153600

(51) Int. Cl.
*H01R 13/648* (2006.01)

(52) U.S. Cl. ..... 439/608

(58) Field of Classification Search ..... 439/608, 439/701, 541.5, 79

See application file for complete search history.

(56) References Cited

U.S. PATENT DOCUMENTS 6,146,202 A 11/2000 Ramey et al.

6,231,391 B1 * 5/2001 Ramey et al. ..... 439/608

FOREIGN PATENT DOCUMENTS

EP 1018 784 7/2000

OTHER PUBLICATIONS

International Search Report of parent International Patent Application No. PCT/US02/16388, Nov. 5, 2002.

* cited by examiner

*Primary Examiner*—Javaid H. Nasri
(74) *Attorney, Agent, or Firm*—Thomas D. Paulius

(57) ABSTRACT

A plug connector is provided with a housing into which the receptacle connector is to be inserted, and a plurality of pin terminals arranged in the housing. The receptacle connector is provided with a plurality of contacts having contact members to be brought into contact with the pin terminals, and a housing holding the contacts. In the plug connector, a plurality of vertical shield plates are provided between the pin terminals. In the receptacle connector, a plurality of horizontal shield plates are provided so as to intersect the vertical shield plates in a cross-like manner. Provided in the housing and the horizontal shield plates of the receptacle connector are slits for allowing insertion of the vertical shield plates. The housing of the plug connector is provided with terminal unit mounting passage for the unit terminals and vertical shield mounting passage for the vertical shield plates.

10 Claims, 10 Drawing Sheets

BOARD CONNECTING CONNECTOR AND METHOD FOR PRODUCING THE SAME

BACKGROUND OF THE INVENTION

The present invention relates to a backplane type connector for connecting circuit boards electrically to each other, and to a method of producing the same.

Board-to-board connectors are widely used for connecting circuit boards to each other in order to increase the density of circuits or realizing a spatial arrangement of multiple circuit boards. These type of connectors generally include receptacle and plug connectors. The receptacle connector is mounted on a vertical circuit board, while the plug connector is mounted on a daughterboard. It is common for the surfaces of the daughterboards to be perpendicular to the surface of the backplane board, when the two connectors being mated together. Examples of the backplane type connector are disclosed in Japanese Patent Publication A-H06-013133 and U.S. Pat. No. 4,655,518

Recently, these backplane connectors have included multiple pin connectors in which the number of terminal pins ranges from several tens to several hundreds, and these are used in high-speed applications. These backplane connectors have the following problems.

The first problem relates to the electromagnetic shielding of the signal terminals. In some backplane connectors, the shield is only partly taken into account. For example, there exists a plug connector in which signal terminal pins are arranged in a plurality of rows and in a plurality of columns in the connector housing. Shield plates extend in the vertical direction at intervals in the housing width direction. As a result, cross-talk is generated between signal terminals between which there exists no shield plate.

The second problem is related to the manufacturability and production cost of the receptacle connector. There exists a receptacle connector equipped with a large number of contacts in which there are arranged in a lattice-like fashion, for example, 25 pins in the housing width direction and five pins in the housing thickness direction. In this receptacle connector, the large number of contacts are forced into attachment holes of the housing and attached thereto. In the process, the contacts and shield plates are alternately forced into the holes. Since the shield plates are forced in vertically, only five vertical rows of contacts can be forced in at one time. As a result, it is necessary to perform the contact-forcing-in process and the shield-plate-forcing-in process for every 25 times each, that is, for every 50 times in total, resulting in poor manufacturability and high production cost. Needless to say, the problem of the shield described above, is not solved in this case, either.

Japanese Patent Publication A-H07-114952 discloses a multi-polar electric connector in which shielding is possible not only between signal terminals of different rows but also between adjacent signal terminals of the same row. This technique is suitable for a relatively simple connector with a small number of poles. However, as the number of poles increases, the number of parts including shield plates, increases steeply, resulting in an increase in production cost due to the increase in assembly man-hour and the complication of the assembly operation. Further, the larger the number of poles is, the more complicated and the more delicate the housing becomes, which leads to a problem related to formability and a problem related to the manufacturability of the mold.

SUMMARY OF THE INVENTION

It is an object of the present invention to solve the problem of the shield in a connector to thereby prevent the generation of cross-talk or the like and, further, to achieve, by forming the connector components as units, a reduction in assembly man-hour and an improvement in formability and manufacturability to thereby achieve an overall reduction in production cost.

To achieve the above object, the present invention adopts the following means.

A backplane type connector for connecting boards electrically to each other comprises a receptacle connector mounted on one board and a plug connector mounted on the other board. The plug connector includes an opening into which the receptacle connector is inserted, and a plurality of pin terminals arranged in a lattice-like fashion in a plurality of vertical and horizontal rows with respect to the housing, and a plurality of vertical shield plates arranged parallel to each other between the pin terminals. The receptacle connector includes a plurality of contacts provided with contact members to be brought into electrical contact with the pin terminals, a plurality of horizontal shield plates arranged parallel to each other so as to intersect the vertical shield plates in a cross-like fashion, and a housing holding the contacts and the horizontal shield plates. Provided in the housing and the horizontal shield plates of the receptacle connector are slits for allowing insertion of the vertical shield plates.

In accordance with the present invention, in the receptacle connector, a plurality of horizontal shield plates arranged in parallel are provided so as to intersect the vertical shield plates of the plug connector in a cross-like fashion, so that there exist shield plates in all the spaces between the signal terminals, whereby the problem of the shield in the connector is solved to thereby preventing the generation of cross-talk or the like.

Further, in accordance with the present invention, the plurality of pin terminals of the plug connector are formed as unit terminals in which the vertical rows of pin terminals between the vertical shield plates are integrated by resin mold portions, and the housing of the plug connector is provided with terminal unit mounting passages for the unit terminals and vertical shield mounting passages for the vertical shield plates. In this way, the plug connector is also in a unit form, whereby it is possible to achieve a reduction in assembly man-hour and an improvement in formability and manufacturability, thereby reducing overall production cost.

It is desirable that the housing of the plug connector of the present invention be provided with a top plate, a bottom plate, and a back plate so as to exhibit a C-shaped sectional configuration, and that the terminal unit mounting passages be provided in the back plate, the vertical shield mounting passages being provided at least in the back plate, and additionally in the top plate and/or the bottom plate. This enables the vertical shield plates to be supported in a stable manner by three portions (three-point support): the back plate, the top plate, and the bottom plate forming the vertical shield mounting passages.

Here, it is desirable that the terminal unit mounting passages be formed by a plurality of terminal insertion holes provided in the back plate, and that the vertical shield mounting passages be formed by a plurality of slits provided in the back plate and guide grooves provided in the top plate and the bottom plate and adapted to guide the upper edge portions and the lower edge portions of the vertical shield plates. The plurality of insertion holes retain the pin terminals at fixed positions. The slits provided in the back plate serve to enable the vertical shield plates to be inserted into the housing, and the guide grooves serve to retain the upper edge portions and lower edge portions of the vertical plates at fixed positions, whereby the mounting and positioning of the vertical shield plates with respect to the housing are facilitated.

It is desirable that at least one ground tail connected to the other board be provided in the vertical shield plates of the plug connector at an arbitrary position. When a ground tail is thus provided in the vertical shield plates, it is possible to provide the ground tail simultaneously with the vertical shield plates when processing the latter, so that not only is it possible to achieve a satisfactory manufacturability, but also the number of ground tales can be easily changed as needed. Further, the ground tail can be easily provided at an arbitrary position in the vertical shield plates in correspondence with the arrangement position, place, etc. of the other board to which it is connected.

In accordance with the present invention, the receptacle housing, the contacts, etc. are formed as units, and the horizontal shield plates are integrated with the housing units, whereby it is possible to achieve a reduction in assembly man-hour and an improvement in moldability (formability) and manufacturability, thereby achieving a reduction in overall production cost.

Further, by stacking a plurality of housing units in a plurality of stages in the housing thickness direction and connecting them to each other, it is possible to reduce the number of housing units.

In the present invention, when the pin terminals and the contact members of the contacts are in a state in which they are electrically connected to each other, it is desirable that the periphery of each connection portion be surrounded by vertical shield plates and horizontal shield plates. By thus surrounding the peripheries of the connection portions where the pin terminals are connected to the contact members by the vertical shield plates and the horizontal shield plates, it is possible to prevent cross-talk more reliably.

The horizontal shield plates of the present invention may be integrated with the respective housing units by insert molding. In this case, it is possible to integrate the horizontal shield plates with the housing units when forming the latter, so that it is possible to achieve an improvement in both manufacturability and assembly property.

Further, it is desirable that at least one ground tail connected to the other board be provided in the horizontal shields at an arbitrary position. When a ground tail is thus provided also in the horizontal shield plates, it is possible to provide the ground tail simultaneously with the horizontal shield plates when processing the latter, so that not only is the manufacturability satisfactory, but also it is possible to change the number of ground tails as needed.

It is also desirable to adopt a construction in which, in each housing unit, attachment holes for the contact modules are arranged at intervals in the housing unit width direction, the slits being provided between the attachment holes. By thus providing the slits between the attachment holes, it is possible to allow the vertical shield plates on the plug connector side to enter the portions between the attachment holes.

It is also desirable that engagement portions adapted to engage with each other to join the housing units to each other be provided on the joint surfaces of the housing units. Due to the engagement portions, the housing units can be easily and detachably joined together without being glued to each other.

It is also desirable to provide a plurality of contact modules respectively connected to the rear ends of the housing units, each contact module being provided with a group of contacts to be forced into the respective attachment holes and a group of tails serving as leading conductors connecting the contacts to the board, the portion of each contact module other than the group of contacts and the group of tails being resin-molded. In this construction, the housing units can be connected to the contact modules solely by fitting the group of contacts into the respective attachment holes, whereby it is also possible to simultaneously force in a plurality of groups of contacts corresponding to horizontal rows for connection.

On the other hand, the method of the invention is a method for producing a receptacle connector comprising a plurality of first and second housing units which are stacked together in a plurality of stages and can be connected to each other, a lower stage housing unit provided in the lowermost stage, an upper stage housing unit provided in the uppermost stage, horizontal shield plates respectively provided in the housing units, and contact modules respectively connected to the rear ends of the housing units. The method comprises the following first to fourth steps.

A first step for integrating the horizontal shield plates respectively with the housing units beforehand.

A second step for connecting vertically adjacent housing units to each other while alternately stacking in a plurality of stages the first and second housing units provided with the horizontal shield plates.

A third step for connecting the lower stage housing unit to the first housing unit and connecting the upper stage housing unit to the second housing unit.

A fourth step for forcing the contact modules into the rear end portions of the housing units for connection.

In the production method of the present invention, a plurality of first and second housing units that can be stacked together in a plurality of stages and connected to each other, a lower stage housing unit provided in the lowermost stage, an upper stage housing provided in the uppermost stage, horizontal shield plates respectively provided on the housing units, and contact modules connected to the respective rear ends of the housing units, are assembled. By integrating the horizontal shield plates respectively with the housing units beforehand, it is possible to simplify the construction of the connector as a whole and facilitate the assembly thereof.

In actually assembling the connector, vertically adjacent housing units are joined to each other while alternately stacking the first and second housing units provided with the horizontal shield plates in a plurality of stages, whereby it is possible to simultaneously force in all the contacts arranged in horizontal rows. Thus, the contact forcing-in process is in correspondence with the number of stages in which the housing units are stacked together. For example, when the number of stages is five, it is only necessary to perform the contact forcing-in step five times. In this way, the number of times that the contact forcing-in step is performed is reduced, thereby achieving an improvement in manufacturability and a reduction in production cost.

It is desirable that, in the first step, the horizontal shield plates be respectively integrated with the housing units by insert molding. When this method is adopted, the horizontal shield plates can be integrated with the housing units when forming the latter, so that it is possible to achieve an improvement in both manufacturability and assembly property.

Further, it is desirable to provide on the joint surfaces of the housing engagement portions adapted to engage with each other to join the housing units to each other. This is very convenient in performing the operation of assembling the housing units in turns by successively stacking them together.

In the process, it is desirable to cause the engagement portions to engage with each other by causing the second housing units to make a relative movement from the rear to the front side of the first housing units. This helps to further improve the assembly operation.

Further, it is desirable to provide short bars for electrically connecting the horizontal shield plates after the receptacle connector has been assembled by the first through fourth steps. This makes it possible to short-circuit the horizontal shield plates, thereby making it possible to obtain a more stable shield property.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

Figure 3:
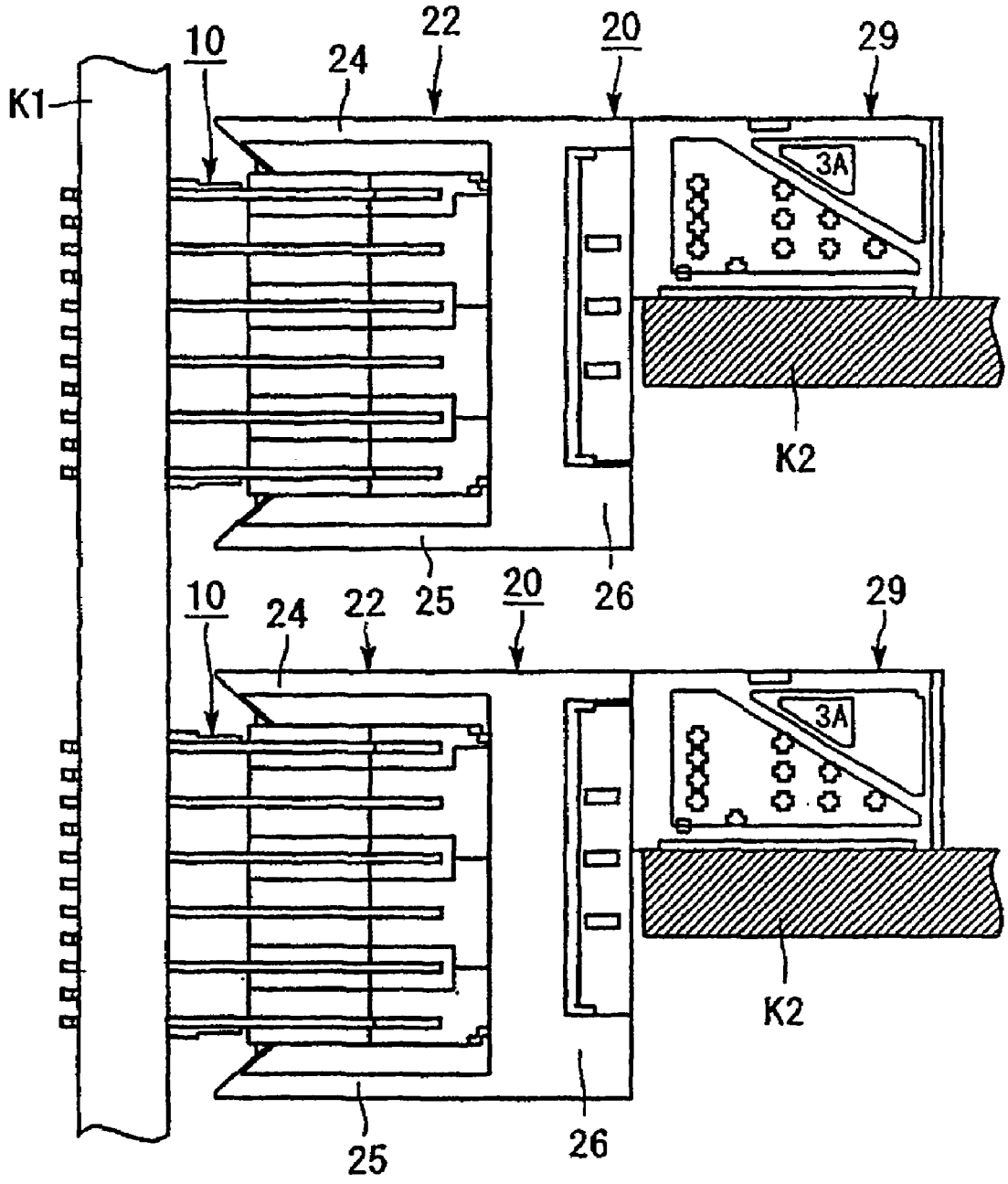
FIG. 3 is a vertical sectional view showing how a backplane type connector according to an embodiment of the present invention is connected.

In this embodiment, the present invention is applied to a backplane type connector for electrically connecting boards, which are connected in a so-called right-angle connection, in which the surfaces of the boards cross each other at right angles. This backplane type connector comprises, as shown in FIG. 3, a receptacle connector 10 mounted on the surface of vertical board K1 and a plug connector 20 mounted on the surface of a daughter board K2.

Figure 2:
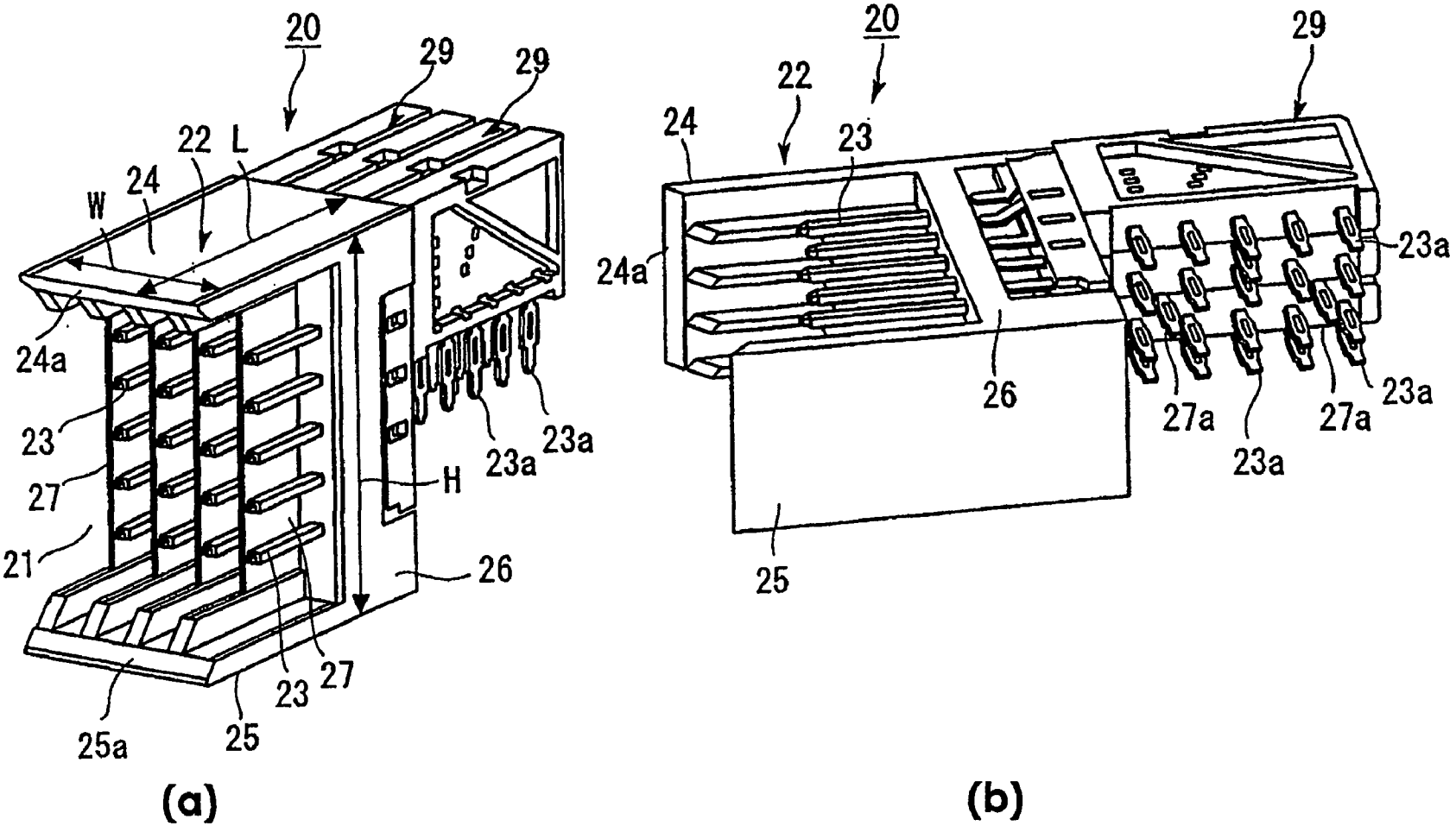
FIG. 2 is a diagram showing an embodiment of the present invention, of which portion (a) is a perspective view of a plug connector and portion (b) is a perspective view of the same as seen from the bottom side.

As shown in FIG. 2, the plug connector 20 is provided with a housing 22 having an opening 21 into which the receptacle connector 10 is to be inserted, and a plurality of pin terminals 23 arranged in a lattice-like fashion with respect to the housing 22. The housing 22 is of a C-shaped configuration in a side view and has a top plate 24, a bottom plate 25, and a back plate 26. The housing 22 is formed such that its width W is smaller than its height H or length L. For convenience in representation of the drawings, the pin terminals 23 are arranged in five stages in the height direction of the housing 22, and in four rows in the width direction thereof, i.e., there are twenty of them in total. All the pin terminals 23 are formed as rectangular pins. In this housing 22 the width W varies by large amounts depending on the number of the pin terminals 23 as shown in FIG. 7.

The entire housing 22 is formed of an insulating resin, and all the pin terminals 23 extend through the back plate 26 of the housing 22 in the thickness direction thereof, whereby the pin terminals 23 are electrically insulated from each other. Formed on the top plate 24 and the bottom plate 25 of the housing 22 are guide slopes 24*a* and 25*a* for facilitating the insertion of the receptacle connector 10.

In the housing 22, a plurality of vertical shield plates 27 constituting the plug side shield are arranged at equal intervals in the width direction of the housing 22. Each vertical shield plate 27 is formed as a rectangular plate, and is arranged between pin terminals 23 adjacent to each other in the width direction of the housing 22. The vertical shield plates 27 are arranged vertically, whereby each vertical row of pin terminals, consisting of five pin terminals 23, is segregated by the vertical shield plates 27 (i.e., placed between vertical shield plates). The pin terminals 23 are of the same length, and are longer than the length of the vertical shield plates 27. Right-angled terminal units 29, which are forced into the housing 20, are to be described next.

Figure 7:
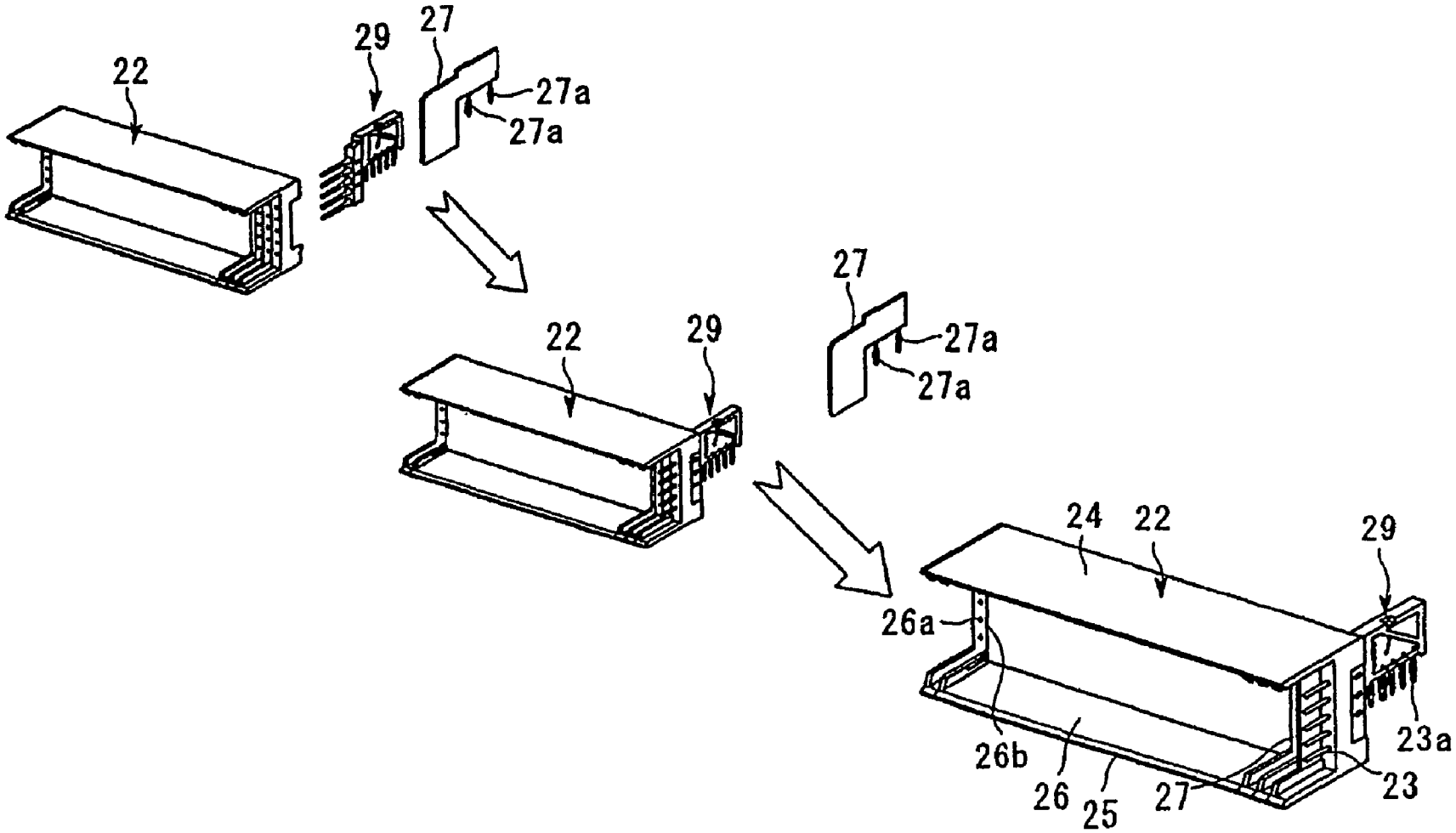
FIG. 7 is a perspective view showing how a plug connector according to an embodiment of the present invention is assembled.

As shown in FIGS. 2 and 7, each right-angled terminal unit 29 is formed as a unit provided with a plurality of pin terminals 23 which are main components of the plug connector 20, and tails 23*a* which are orthogonal to the pin terminals 23 to connect the pin terminals to the daughter board. Thus, the plug connector 20 is formed by a housing 22, a plurality of (three or more) right-angled terminal units 29, and a plurality of vertical shield plates 27. Each vertical shield plate 27 is provided with a ground tail 27*a*. A plurality of (e.g., two to five) ground tails 27*a* are provided as needed at arbitrary positions of the vertical shield plate 27*a*.

Figure 8:
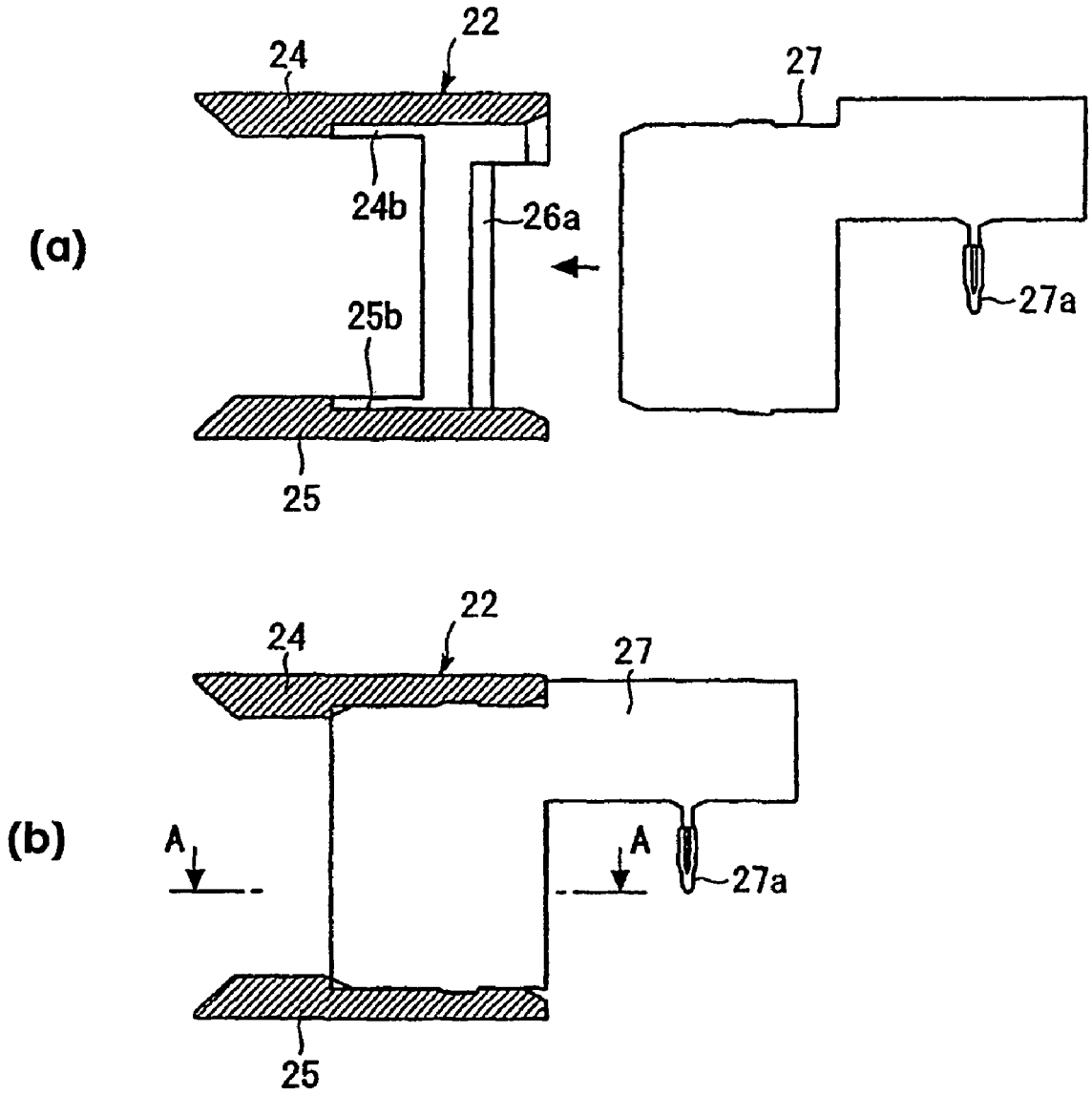
FIG. 8 is a sectional view showing how a plug connector according to an embodiment of the present invention is assembled.
Figure 9:
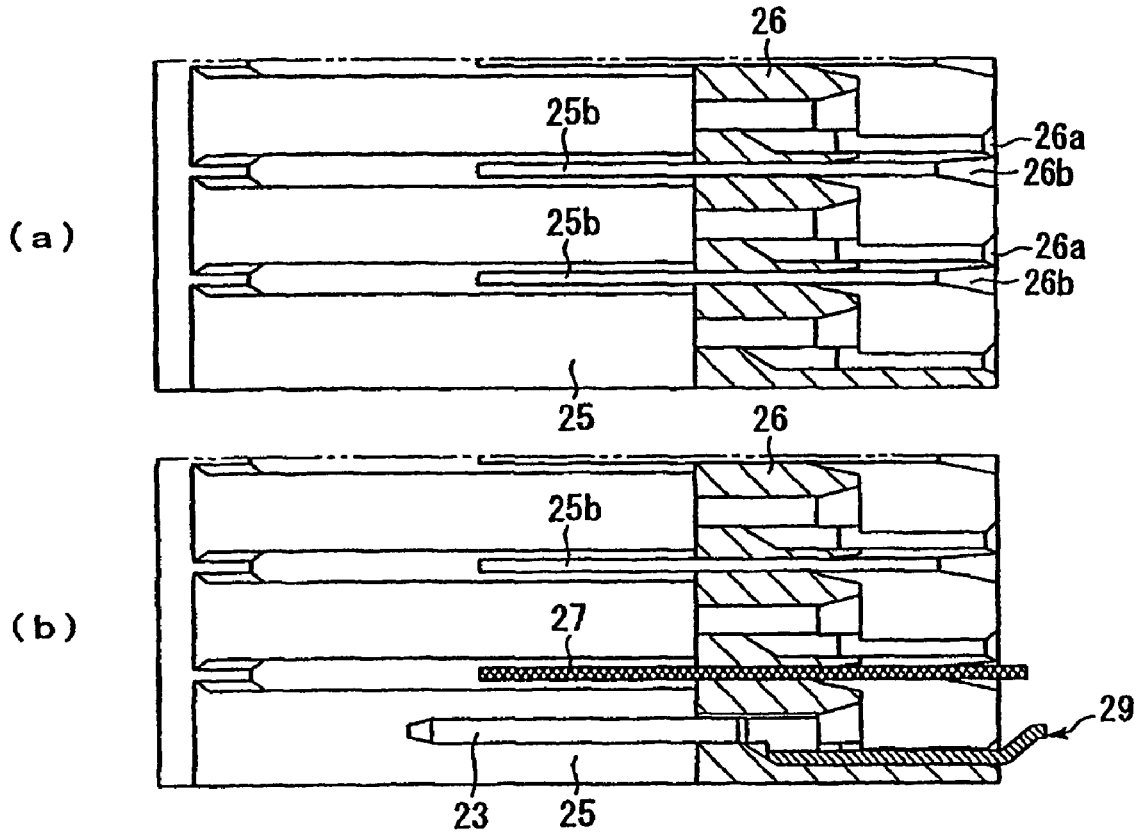
FIG. 9 is a sectional view taken along the line A—A of FIG. 8, of which portion (a) shows a state in which a right-angled unit and a vertical shield plate have not been forced in yet, and portion (b) shows a state in which they have been forced in; and, FIG. 10 is a model diagram showing the board layout of a plug connector according to an embodiment of the present invention.

As shown in FIGS. 8 and 9, the back plate 26 of the housing 22 is provided with mounting passages 26*a* for the pin terminals 23 of the right angled terminal unit, and other mounting passages 26*b* for the vertical shield plates 27. Further, in the top plate 24 and the bottom plate 25, there are provided guide grooves 24*b* and 25*b* for supporting the vertical shield plates 27 in a stable manner. Thus, as shown in FIGS. 7 through 9, by inserting the right-angled terminal units 29 and the vertical shield plates 27 into the housing 22, the plug connector 20 is formed.

Figure 10:
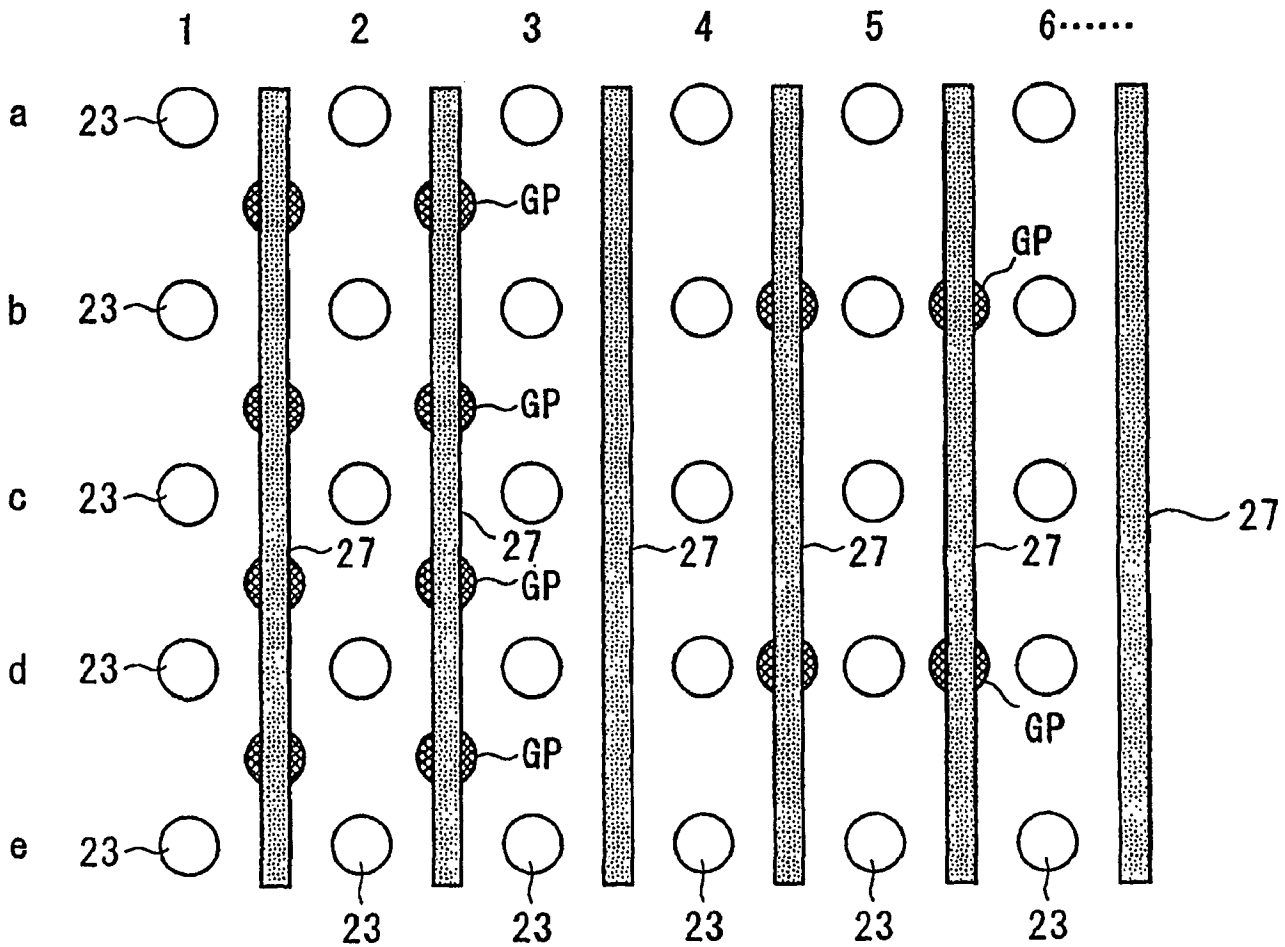

FIG. 10 is a model diagram showing an example of the board layout of the plug connector 20. In the drawing, the vertical axes a through e indicate the number of stages, and the horizontal axes 1 through 6 indicate the number of rows of pin terminals (signal pins) 23. As shown in the drawing, the vertical shield plates 27 are connected to ground pins GP. The diagram shows by way of example a case in which two ground pins GP are provided, and a case in which four ground pins are provided.

Figure 4:
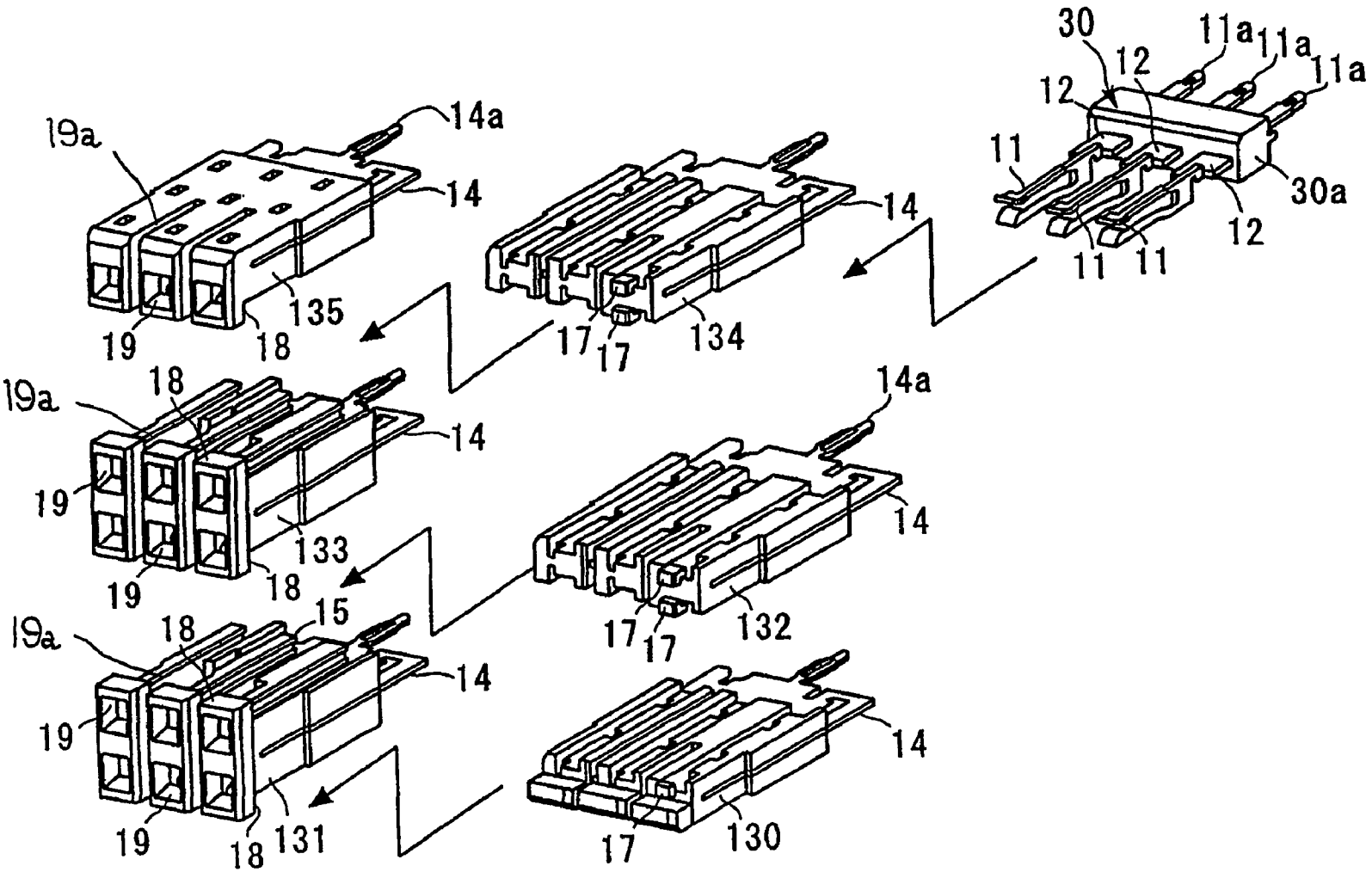
FIG. 4 is a perspective view showing how a receptacle connector according to an embodiment of the present invention is assembled.
Figure 5:
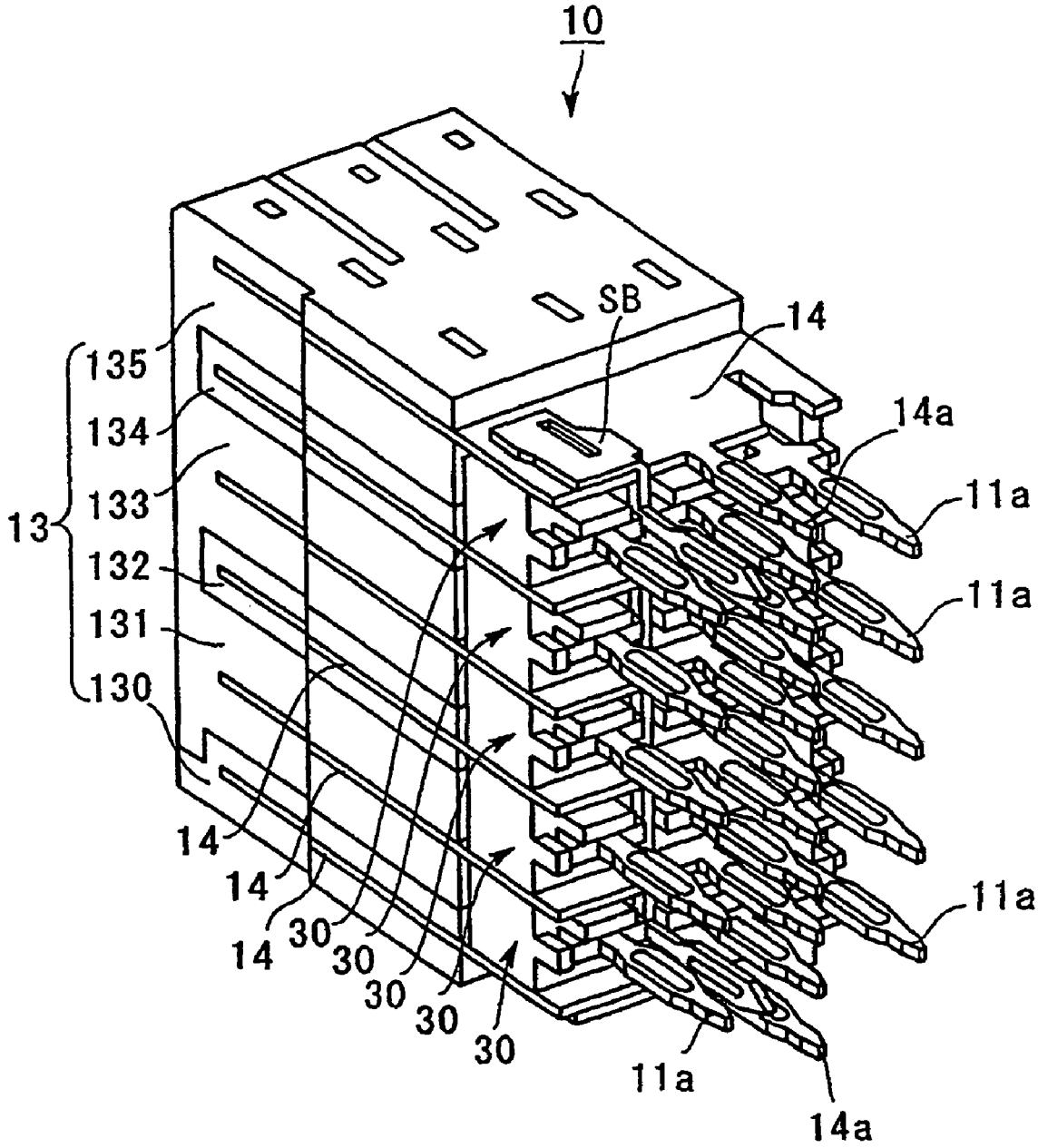
FIG. 5 is a backside perspective view of a receptacle connector according to an embodiment of the present invention.

The receptacle connector 10 comprises a plurality of contacts 12 each having a pair of contact members 11 (See FIG. 4(*b*)) adapted to come into electrical contact with each pin terminal 23 of the plug connector 20, and a housing 13 (See FIG. 1) for holding the contacts 12. Provided in the receptacle connector 10 are a plurality of horizontal shield plates 14 arranged in parallel to each other and constituting the receptacle side shield. The horizontal shield plates 14 intersect the vertical shield plates 27 of the plug connector 20 in a cross-like fashion. Slits (not shown) for allowing insertion of the vertical shield plates 27 are provided in the housing 13 and the horizontal shield plates 14 of the receptacle connector 10.

The housing 13 of the receptacle connector 10 is composed of a plurality (five stages) of housing units 131 through 135 stacked together in a plurality of stages in the thickness direction of the housing 13. For each of the housing units 131 through 135, a horizontal shield 14 is integrally provided. In the lowermost stage of the housing 13, there is provided a bottom housing unit 130 equipped with a horizontal shield plate 14.

While there are various ways of integrally providing the horizontal shield plates with respect to the housing units, the horizontal shield plates 14 in this example are, from the viewpoint of productivity, integrated with the housing units 130 through 135 by insert molding. The respective horizontal shield plates 14 are placed in the middle portion with respect to the thickness direction of the housing units 130 through 135.

Figure 1:
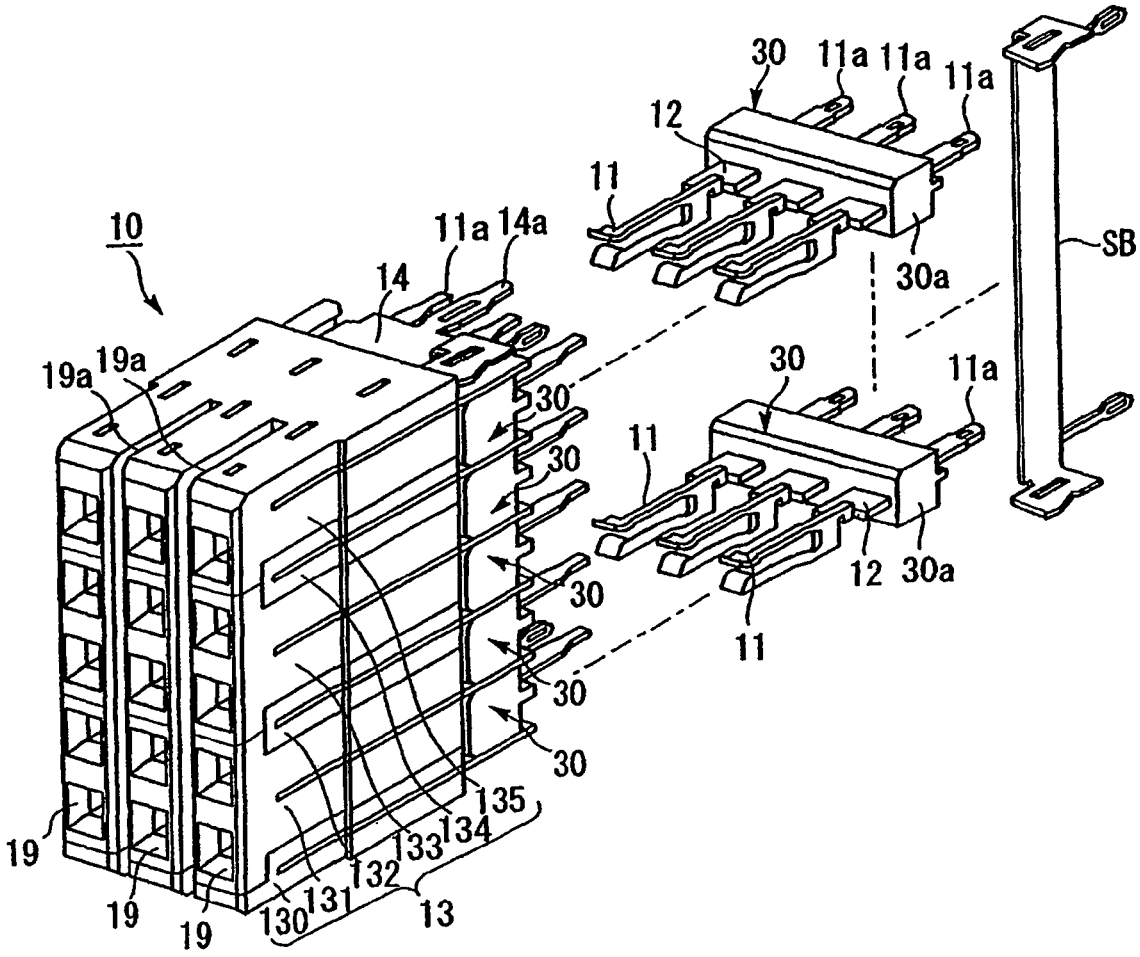
FIG. 1 is a perspective view of the assembly parts of a receptacle connector according to an embodiment of the present invention.

Since the horizontal shield plates 14 are placed horizontally, their plane area is larger than that of the vertical shield plates 27. Each of the horizontal shield plates 14 have the same plane area. The length of each horizontal shield plate 14 is such that it protrudes beyond the rear ends of the housing units 131 through 135. As best seen in FIG. 1, the horizontal shield plates 14 are electrically connected by two short bars SB extending in a direction intersecting them at 90 degrees (vertical direction).

In this embodiment, the housing units are formed by four kinds of housing units: first housing units 131 and 133, second housing units 132 and 134, a lower stage housing unit 130, and an upper stage housing unit 135. Thus, when increasing or decreasing the number of stages, the number of first and second housing units is increased or decreased.

As shown in FIG. 4, formed on the joint surfaces of the housing units are male engagement portions 17 and female engagement portions 18 which engage with each other to join the housing units together. The male engagement portions 17 are formed as protrusions, and the female engagement portions 18 are formed as recesses allowing horizontal insertion of the male engagement portions 17.

The male engagement portions 17 are provided in the lower stage housing unit 130, and the second housing units 132 and 134. The female engagement portions 18 are provided in the first housing units 131 and 133 and the upper stage housing unit 135.

The male engagement portion 17 of the lower housing unit 30 is provided in the upper portion at one end thereof. The female engagement portions 18 of the second housing units 132 and 134 are provided in the upper and lower portions at one end thereof.

The female engagement portions 18 of the first housing units 131 and 133 are provided in the upper and lower portions at one end thereof. The female engagement portion 18 of the upper stage housing unit 135 is provided in the lower portion at one end thereof.

These engagement portions engage by a so-called "hook" system. As shown in FIG. 4, vertical insertion easily effects joining. Numeral 15 indicates guide protrusions for joining housing units to each other. Regarding the structure for this engagement, it is possible to adopt some other engagement structures.

In each of the housing units 131 through 135, attachment holes 19 for the contacts 12 are arranged at intervals in the housing unit width direction. And, slits 19*a* are provided between the attachment holes 19.

The receptacle connector 10 is provided with a plurality of (five, in this embodiment) contact modules 30 respectively connected to the rear ends of the housing units 131 through 135. Each contact module 30 is provided with a group of contacts 11 respectively forced in the attachment holes 19, and a group of tails 11*a* serving as leading conductors for connecting the contacts to the vertical board.

The portion of each contact module 30 other than the group of contacts 11 and the group of tails 11*a* constitutes a retaining portion 30*a* formed by resin molding. Due to this retaining portion 30*a* formed by resin molding, the contacts 12 are electrically insulated while being integrally retained in a horizontal row. Further, this retaining portion 30*a* is tightly inserted between the upper and lower horizontal shield plates 14. This allows each contact module 30 to be connected to the corresponding housing unit in a state in which it is retained in a stable manner.

Figure 6:
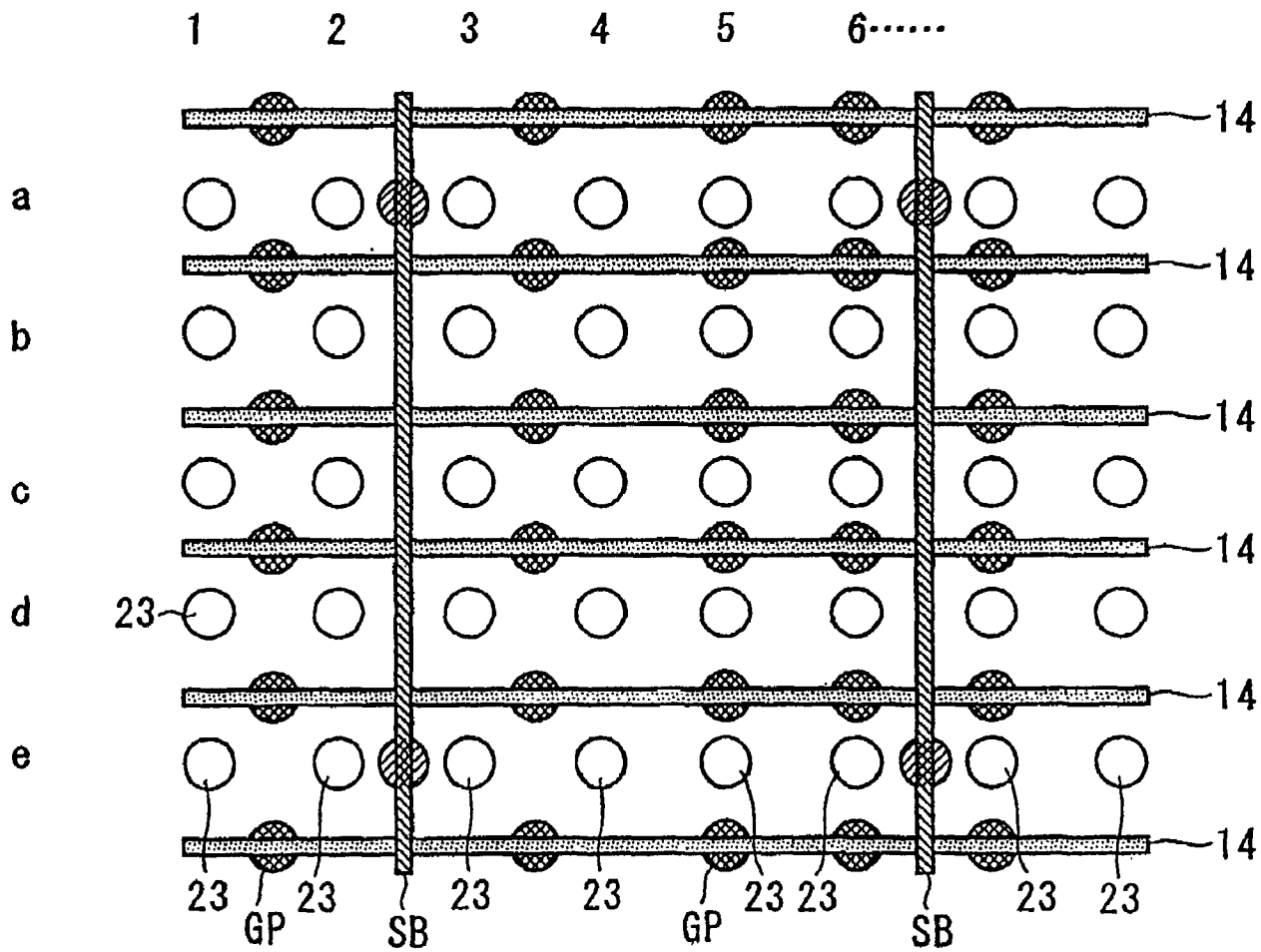
FIG. 6 is a model diagram showing the board layout of a receptacle connector according to an embodiment of the present invention.

FIG. 6 is a model diagram showing an example of the board layout of the receptacle connector 10. In the drawing, the vertical axes a through e indicate the number of stages, and the horizontal axes 1 through 6 indicate the number of row of pin terminals (signal pins) 23. As it is already mentioned, the horizontal shield plates 14 are electrically connected by two short bars SB extending in a direction intersecting them at 90 degrees (vertical direction). Further, the horizontal shield plates are respectively connected to ground pins GP. At least one short bar SB suffices, and a plurality of short bars can be provided as needed.

The plurality of housing units 130 through 135, which are the components of the housing 13, the plurality of horizontal shield plates 14 constituting the receptacle side shields, and the plurality of contact modules 30 are prepared beforehand.

Thereafter, as shown in FIGS. 1 and 4, the second housing unit 132 of the second stage is superimposed on the upper surface of the first housing unit 131 of the first stage, and caused to slide from the rear to the front side, whereby the male engagement portion 17 is engaged with the female engagement portion 18 to effect positioning. Next, the first housing unit 133 is superimposed on the second housing unit 132, and caused to slide backwards, whereby the male engagement portion 17 is engaged with the female engagement portion 18 to effect positioning.

In this assembly process, it is also possible to insert the second housing unit 132 between the first housing units 131 and 133 stacked one upon the other and engage them with each other.

Next, a similar operation is performed on the fourth and fifth stages, and the lower stage housing unit 130 is finally attached, whereby the receptacle housing 13 provided with a plurality of horizontal shield plates 14 is formed. After this, the contact modules 30 are forced in the respective housing units, whereby the receptacle connector 10 shown in FIG. 1 is obtained.

While the preferred embodiment of the invention have been shown and described, it will be apparent to those skilled in the art that changes and modifications may be made therein without departing from the spirit of the invention, the scope of which is defined by the appended claims.

The invention claimed is:

1. A backplane connector comprising:

a receptacle connector for mounting to a vertical board and a plug connector for mounting to a daughter board, the plug connector including an insulative housing having an opening which receives the receptacle connector, a plurality of conductive pin terminals arranged in plurality of vertical columns and horizontal rows within the housing, and a plurality of vertical shielding plates arranged between the pin terminals; said receptacle connector including a plurality of conductive contacts for contacting with the pin terminals, a plurality of horizontal shielding plates spaced-apart for intersecting the vertical shielding plates in a cross-like fashion, and a receptacle connector housing holding the contacts and the horizontal shielding plates; and, wherein slits for allowing insertion of the vertical shield plates are provided in said housing and said horizontal shielding plates of said receptacle connector, and, wherein said plurality of pin terminals are formed as terminal units in which said vertical rows of pin terminals between said vertical shielding plates are integrated, said receptacle connector housing is formed by a plurality of housing units stacked together in a plurality of stages in the vertical direction and connected to each other, said horizontal shielding plates being respectively integrated with said housing units, said horizontal shielding plates being integrally formed with said respective housing units by insert molding.

2. A backplane connector according to claim 1, wherein the terminal units include a plurality of right-angled terminals.

3. A backplane connector according to claim 2, wherein said plug connector housing is formed with a C-shaped sectional configuration and includes a top plate, a bottom plate, and a back plate, and wherein vertical shielding plate mounting passages and terminal unit mounting passages are provided in the back plate.

4. A backplane connector according to claim 3, wherein said terminal unit mounting passages are formed by a plurality of terminal insertion holes provided in said back plate, and wherein said vertical shielding mounting passages are formed as a plurality of slits provided in said back plate, and further including a guide groove at least in said top or bottom plate and adapted to guide either upper edge portions or lower edge portions of said vertical shielding plates.

5. A backplane connector according to claim 1, wherein when said pin terminals and said contacts are in a state in which they are electrically connected to each other, the peripheries of the mating portions are structured so as to be surrounded by said vertical shielding plates and said horizontal shielding plates.

6. A backplane connector according to claim 1, wherein a shorting bar is attached to each of said horizontal shielding plates and electrically connects said horizontal shielding plates together.

7. A backplane connector according to claim 1, wherein, in said horizontal shielding plates, at least one ground tail connected to the vertical board is provided at an designated location.

8. A backplane connector according to claim 1, wherein in each of said housing units, attachment holes for said contacts are arranged at intervals in the horizontal direction, with slits being provided between said attachment holes.

9. A backplane connector according to claim 1, wherein on said housing units, there are provided engagement portions which are engaged with each other to join said housing units to each other.

10. A backplane connector according to claim 1, wherein there are provided a plurality of contact modules respectively connected to the rear ends of said housing units, each contact module having a group of contacts extending through a series of attachment holes of said modules and a group of tails serving as leading conductors for connecting each contact to the daughterboard, a portion of each contact module being formed by resin molding.

* * * * *